United States Patent [19]

Scott

[11] 4,036,204

[45] July 19, 1977

[54] TRIGGER RELEASE DEVICE FOR BOW STRINGS

[76] Inventor: Joseph D. Scott, 2112 S. Fernwood Drive, Savannah, Ga. 31404

[21] Appl. No.: 639,353

[22] Filed: Dec. 10, 1975

[51] Int. Cl.[2] ..... F41B 5/00

[52] U.S. Cl. ..... 124/35 A

[58] Field of Search ..... 124/35 A, 24 R, 23 R, 124/35 R; 128/321

[56] References Cited

U.S. PATENT DOCUMENTS

| | | | |
|---|---|---|---|
| 228,302 | 6/1880 | Beard | 124/35 A |
| 2,488,597 | 11/1949 | Konolo | 124/35 A |
| 3,898,974 | 8/1974 | Keck | 124/35 A |
| 3,921,615 | 11/1975 | Dodge | 124/35 A |

*Primary Examiner*—Richard C. Pinkham
*Assistant Examiner*—William R. Browne
*Attorney, Agent, or Firm*—Patrick F. Henry

[57] ABSTRACT

A release device for drawing the bow string which is released to propel an arrow having an arrangement of first and second pivoted jaw members each having a jaw thereon mounted by means of a pivot pin to a handle. A pivoted trigger member on the handle has a notch therein into which fits a projecting portion on the first jaw member for engagement when the jaws are closed. The jaws are clamped over the bow string and the trigger is pulled to disengage the projecting portion and release the bow string and arrow.

4 Claims, 5 Drawing Figures

TRIGGER RELEASE DEVICE FOR BOW STRINGS

BACKGROUND OF THE INVENTION

1. Field of the Invention

Bow string releases of the sort using a handle and trigger with pivoted jaws that may be locked about the bow string.

2. Description of the Prior Art

There are many bow string release devices in the prior art. The trouble with most of these devices is that the mechanism is too complex either to manufacture or operate and the attachment to the bow string is too complicated and undependable. Furthermore, some of the devices are too expensive for most archers. The present device is simple and easy to operate and almost foolproof in operation.

SUMMARY OF THE INVENTION

A handle and trigger arrangement having pivoted jaws which are attached about a bow string and released by actuation of the trigger.

An object of this invention is to provide a simple device comprising only a few moving parts including a pair of pivoted jaws which are operated only when under forward tension from the bow string by means of a trigger.

Another advantage of this invention is found in the arrangement whereby it may be used in several ways, that is, either as a surprise release, a command release, or use either right or left hand without any adjustment whatsoever and without any damage to the bow string.

Another advantage of this present handle and trigger arrangement is in reducing or eliminating most of creeping, which is the gradual moving forward of the arrow after the bow string is tensioned, since it is very difficult to pull the trigger of the present device, if there is any forward movement of the arrow whatsoever at full draw.

Another advantage of the present invention is that the archer may achieve a more accurate centerline of arrow travel to the target without very much side deflection to left or right as compared with the use of fingers of other types of arrow release devices.

Another advantage of the present invention is the fact that once it is locked on the bow string and is being pulled to full draw it will not release the string until the trigger is manually operated.

An additional advantage of the present invention is found in the use with present day compound bows which have a lighter hold weight because the present device is very easy to release with a very light pull and in fact the lighter the pull the softer the trigger pull. However, even with the heavy pull bows the present trigger is not hard to pull.

An additional object of the present invention is to provide an almost positive release because the head of the release will swivel on the handle to make up for any small error in alignment which are made with the hand and anchor position and in horizontal movement only.

Furthermore, the present device has an oversized hold thereby eliminating any torquing of the string. In addition, when the trigger is pulled the present device will swivel out of the way of the release string because of the almost positive release.

Other and further objects and advantages of the present invention will become apparent upon reading the following specification taken in conjunction with the accompanying drawings, in which.

DESCRIPTION OF A PREFERRED EMBODIMENT

Figure 1:
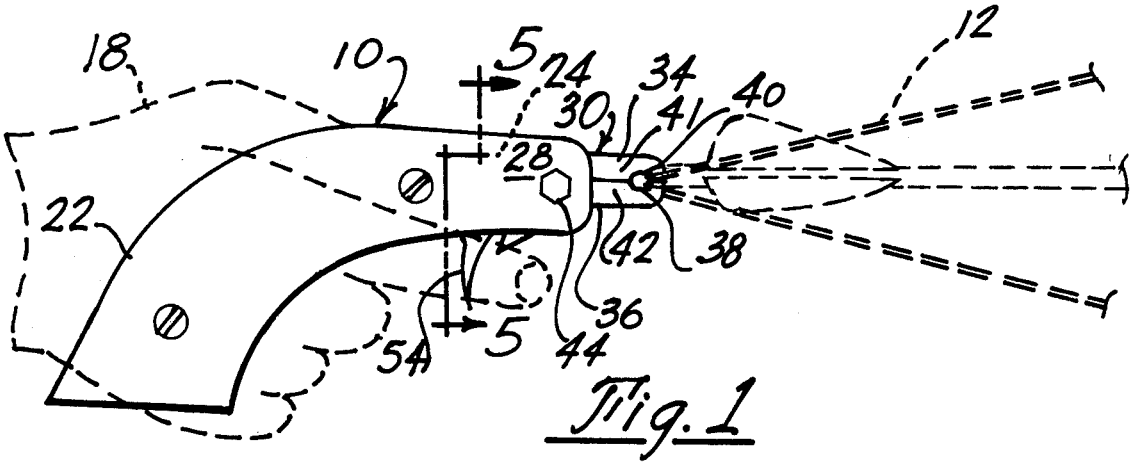
FIG. 1 is a perspective view of the present device shown with the bow string drawn to full position.

The completed device is designated by reference numeral 10 and is shown in place on a conventional bow string 12 drawn to full position on a bow 14 held by an archer 16 in the conventional manner in the hands 18, 20.

The present device comprises a handle 22 which resembles a pistol handle and may be made from metal, plastic or other suitable materials providing a cavity 24 in a forward portion defined by means of opposed sides 26, 28 extending from the handle. The bow string grasping means and trigger arrangement which is designated generally by reference numeral 30 is mounted within the cavity 24 between the sides 26, 28.

Figure 2:
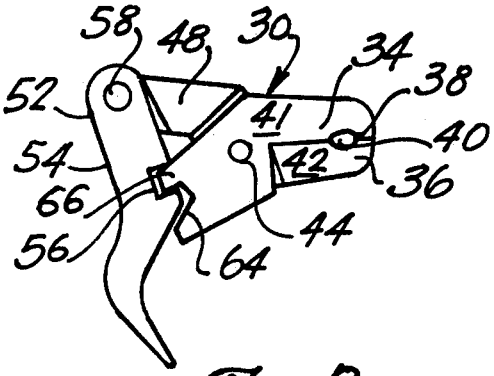
FIG. 2 is a top plan view of the internal mechanism in locked position.
Figure 5:
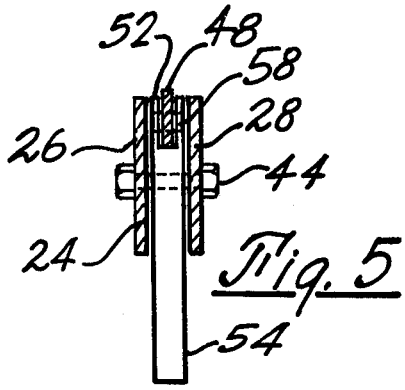
FIG. 5 is a cross-sectional view taken substantially along lines 5—5 in FIG. 1.
Figure 3:
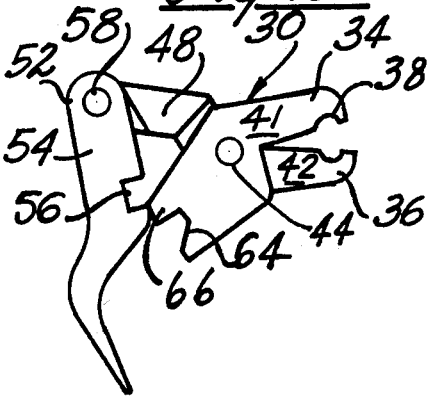
FIG. 3 is a plan view of the internal mechanism in release position.
Figure 4:
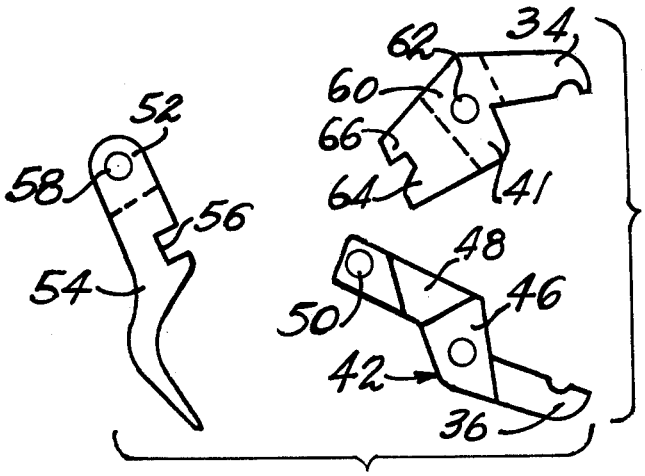
FIG. 4 is a disassembled view of the part shown in FIGS. 2 and 3.

The bow string grasping means 30 comprises a pair of pivoted jaw members 34, 36 each having a small concave portion 38 each having a cavity defining when closed a hole 40 therebetween when the jaws 34, 36 are in closed position as shown in FIG. 2. Each jaw 34, 36 is part of a respective first and second jaw plate 41, 42 which are connected by a pivot pin 44.

The first jaw plate 42 comprises a center portion 46 and a recessed terminal portion 48 having a hole 50 therein which is attached to the elongated portion 52 of the trigger plate 54 which also has a notch 56 therein. The trigger plate 54 has a hole 58 which receives a pin connecting same pivotally in the hole 50 in the first jaw plate 42. The second jaw plate 41 comprises the jaw 34 and a rearward portion 60 having a hole 62 therein which receives the pivot pin 44 to attach the jaws 34, 36 together. There is also a notch 64 in the second jaw plate 41 defining a protrusion 66 which is adapted to fit into a notch 56 on the trigger plate 54 when the jaws are together in the position of FIG. 2 and therefore closed about the bow string 12.

OPERATION

In the operation of the device, the trigger 54 is actuated by the finger of the hand while the device is held in the hand to open the jaws 34, 36 for the insertion of the bow string 12 in the hole 40 defined by the cavities 38. The thumb is used to close the jaws 34, 36 on the bow string which lets the trigger 54 press against the back bringing the protrusion 66 of the jaw 34 into the notch 68 on the trigger to the final position shown in FIG. 2. In this final position shown in FIG. 2, the bow string is loosely clamped in the hole 40 defined by jaws 34, 36 and will not be released until pressure is exerted to pull the trigger 54 so as to disengage the protrusion 66 from the slot 56 whereupon the tension from the bow string will cause the release and the delivery of the arrow.

The design of the hole between the jaws 34, 36 is slightly egg-shaped and the more pressure on the jaws will cause more pressure on the engagement between the protrusion 66 in the slot 56 causing same to hold until the trigger 54 is positively activated to pull the slot 56 away from the member 66.

While I have shown and described a particular embodiment of this invention together with a suggested mode of operation this is by way of illustration only since there are various alterations, changes, deviations, eliminations, substitutions, revisions and departures which may be made in the embodiment shown without departing from the scope of the invention as shown in the appended claims.

What is claimed:

1. In a release device for the bow string of a bow which is used to propel an arrow:

a handle, a pair of first and second opposed jaws pivotally mounted on said handle and each of said jaws having a cavity therein so that said jaws when closed together from an opening therebeneath in which a bow string is confined, a first jaw member including said first jaw thereon and a second jaw member including said second jaw thereon, said first and second jaw members each being elongated and having a respective first pivot connected by first pivot means therebetween, said first pivot means mounting said first and second jaw members on said handle, a trigger member having a pivot attaching portion and there being second pivot means pivotally connecting the pivot attaching portion of said trigger member with said second jaw member, a trigger on said trigger member, a notch in said trigger member, and a projecting portion on said first jaw member for engagement in said notch in said trigger member when said jaws are closed.

2. The device in claim 1 wherein said first jaw member is formed with a recessed cavity thereon receiving part of said trigger member therein, said second jaw member also having a recessed cavity thereon receiving part of said first jaw member therein whereby said first jaw member fits into the cavity in said second jaw member.

3. The device in claim 1 wherein the first jaw member comprises a center portion and a recessed terminal portion with a hole therein, said trigger member having a hole therein, matching with said hole in said first jaw member, a pivot pin connecting said first jaw member and said second jaw member.

4. The device in claim 3, said second jaw member comprising a notch defining therewith the protrusion which fits into the notch in the trigger member.

* * * * *